US011005215B2

(12) United States Patent
Motohashi

(10) Patent No.: US 11,005,215 B2
(45) Date of Patent: May 11, 2021

(54) CONNECTOR AND CONNECTOR ASSEMBLY

(71) Applicant: Molex, LLC, Lisle, IL (US)

(72) Inventor: Kyoko Motohashi, Yamoto (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/400,046

(22) Filed: May 1, 2019

(65) Prior Publication Data

US 2020/0014145 A1 Jan. 9, 2020

(30) Foreign Application Priority Data

Jul. 3, 2018 (JP) ..... JP2018-126477

(51) Int. Cl.
*H01R 13/58* (2006.01)
*H01R 13/627* (2006.01)
*H01R 13/42* (2006.01)

(52) U.S. Cl.
CPC ..... *H01R 13/6273* (2013.01); *H01R 13/42* (2013.01)

(58) Field of Classification Search
CPC .. H01R 23/725; H01R 12/57; H01R 13/6275; H01R 13/516; H01R 24/28; H01R 23/7073
USPC ..... 439/74, 83, 357, 468, 682, 692, 660
See application file for complete search history.

(56) References Cited

U.S. PATENT DOCUMENTS 4,820,179 A * 4/1989 Saijo ..... H01R 4/2466 439/224
5,277,597 A * 1/1994 Masami ..... H01R 12/57 439/83
6,068,502 A 5/2000 Kuo
6,908,345 B2 * 6/2005 Shimizu ..... H01R 13/62905 439/342
7,112,102 B2 * 9/2006 Masaki ..... H01R 13/113 439/660

(Continued)

FOREIGN PATENT DOCUMENTS

CN 102801046 A 11/2012
CN 103682824 A 3/2014

(Continued)

*Primary Examiner* — Thanh Tam T Le

(57) ABSTRACT

Provided is a housing including a bottom wall, a front-end wall, side walls, and a mating space. Each of the side walls includes a locking protrusion configured to engage with a counterpart locking protrusion locking protrusion of a counterpart housing when the counterpart housing is inserted into the mating space. Each of the side walls also includes an auxiliary-metal-fixture mounting portion configured to be loaded with an auxiliary metal fixture having a bottom end that is to be fixed to a surface of a board. The terminal is configured to be loaded in the front-end wall, and includes a connection part having a bottom end that is to be fixed to the surface of the board. The bottom wall has a surface facing the surface of the board, slanted surfaces are formed respectively on the left side edge and the right side edge of the surface of the bottom wall so that each slanted surface extends, in the front-to-rear direction of the sidewall, towards the outer side of the housing with a gradually widening gap with the surface of the board.

7 Claims, 8 Drawing Sheets

(56) References Cited

U.S. PATENT DOCUMENTS

| | | | | |
|---|---|---|---|---|
| 7,118,424 | B2 * | 10/2006 | Masaki | H01R 13/11 439/682 |
| 7,828,585 | B2 * | 11/2010 | Kurimoto | H01R 13/02 439/357 |
| 7,901,218 | B2 * | 3/2011 | Sato | H01R 12/716 439/74 |
| 8,043,114 | B2 * | 10/2011 | Kaneko | H01R 12/714 439/497 |
| 8,052,457 | B2 * | 11/2011 | Miyazaki | H01R 12/714 439/357 |
| 8,257,095 | B2 * | 9/2012 | Akai | H01R 12/716 439/248 |
| 8,727,813 | B2 * | 5/2014 | Yang | H01R 12/732 439/500 |
| 8,961,215 | B2 * | 2/2015 | Hasegawa | H01R 12/716 439/346 |
| 9,184,531 | B2 * | 11/2015 | Chen | H01R 13/518 |
| 9,246,260 | B2 * | 1/2016 | Naganawa | H01R 13/516 |
| 9,287,643 | B2 * | 3/2016 | Yoshida | H01R 12/75 |
| 9,647,401 | B2 * | 5/2017 | Sato | H01R 24/005 |
| 2017/0288339 | A1 | 10/2017 | Sato | |

FOREIGN PATENT DOCUMENTS

| | | | |
|---|---|---|---|
| CN | 103855535 | A | 6/2014 |
| CN | 206490200 | U | 9/2017 |
| JP | 2004-178960 | A | 6/2004 |
| JP | 4115983 | B2 | 7/2008 |
| TW | M492558 | U | 12/2014 |
| TW | M512832 | U | 11/2015 |

* cited by examiner

Prior art

CONNECTOR AND CONNECTOR ASSEMBLY

RELATED APPLICATIONS

This application claims priority to Japanese Application No, 2018-126477, filed on Jul. 3, 2018, which application is incorporated herein by reference in its entirety.

TECHNICAL FIELD

The present disclosure relates to a connector and a connector assembly.

BACKGROUND ART

Conventionally, in a connector for connecting an electric wire such as a cable to a circuit board such as a printed circuit board, the housing of the wire connector is locked to the housing of the connector mounted on the board in order to maintain the mating between the connector mounted on the board and the wire connector connected to the wire (see, for example, Patent Document 1).

FIG. 8 is a perspective view illustrating a connector of a prior art.

A housing 811 of a connector is illustrated in FIG. 8. The housing 811 is mounted on a circuit board 891 used in electronic devices, electrical machinery and apparatuses and the like. The connector mates with a wire connector connected to a termination of a wire of a cable (not illustrated). In addition, the housing 811 includes left and right side walls 817 that define a mating space 813 into which a housing of a wire connector is inserted. In addition, the housing 811 includes engaging protrusions 818, each of which protrudes inwardly from the inside surface of the corresponding one of the side walls 817. An engaging recess 816 is formed directly under the corresponding one of the engaging protrusions 818. In addition, the housing 811 includes a terminal 861 that comes into contact with the terminal of the wire connector.

When the wire connector and the connector mounted on the circuit board 891 are mated together, the operator pushes the housing of the wire connector into the mating space 813 of the housing 811 of the connector mounted on the circuit board 891 with his/her hand fingers. The engaging protrusions of the housing of the wire connector ride over the engaging protrusions 818 of the housing 811, and thus enter the engaging recess 816. Thus, the engaging protrusion of the wire connector and the engaging protrusion 818 engage with each other. Consequently, the housing of the wire connector and the housing 811 are locked together, and the mating state of the wire connector and the connector mounted on the circuit board 891 is maintained.

Note that when releasing the mating between the wire connector and the connector mounted on the circuit board 891, the operator exerts an extraction force by his/her hand fingers and pulls the housing of the wire connector. Hence, the engaging protrusions of the wire connector are pulled out of the engaging recess 816 past the corresponding engaging protrusions 818, and the locking between the housing of the wire connector and the housing 811 is unlocked. Consequently, the wire connector is removed from the mating space 813 of the housing 811.

Patent Document 1: JP 2006-128034 A

SUMMARY

However, in the above-described conventional connector, the locking is maintained by the frictional force (hence, the locking is what is known as a frictional locking) between each of the engaging protrusions included in the housing of the wire connector and the corresponding one of the engaging protrusions 818 of the housing 811. Hence, when the housing of the wire connector is pressed into the mating space 813 of the housing 811 or is pulled out of the mating space 813, the engaging protrusions included in the housing of the wire connector and the corresponding engaging protrusions 818 of the housing 811 rub against each other, and wear away. Consequently, the lock holding power is reduced.

The present disclosure aims to solve the above-described problem of conventional connectors by providing a highly reliable connector and a highly reliable connector assembly allowing a flexible housing to be elastically deformed so that the locking protrusions do not wear away and that the lock holding power can be maintained.

Provided to this end is a connector including: a housing made from an insulating material; and a terminal loaded in the housing. The connector is configured to be mated with a counterpart connector. The counterpart connector includes: a counterpart housing; and a counterpart terminal loaded in the counterpart housing. The housing includes: a bottom wall facing a surface of a board; a front-end wall extending along a front-end edge of the bottom wall; a left and right pair of side walls connected respectively to a left end and a right end of the front-end wall, and extending respectively along a left side edge and a right side edge of the bottom wall; and a mating space, at least some of whose borders are defined by the bottom wall, the front-end wall, and the side walls. Each of the side walls includes a locking protrusion configured to engage with a counterpart locking protrusion of the counterpart housing inserted into the mating space. The locking protrusion is formed in a portion of the side wall portion apart from a front end and a rear end of the side wall. Each of the side walls also includes an auxiliary-metal-fixture mounting portion formed on the rear end of the side wall and configured to be loaded with an auxiliary metal fixture having a bottom end that is to be fixed to a surface of the board. The terminal is configured to be loaded in the front-end wall, and includes a connection part having a bottom end that is to be fixed to the surface of the board. The bottom wall has a surface facing the surface of the board. Slanted surfaces are formed respectively on the left side edge and the right side edge of the surface of the bottom wall so that each slanted surface extends, in the front-to-rear direction, towards the outer side of the housing with a gradually widening gap with the surface of the board.

Also provided is another connector in which the front-end wall may further include cut-away portions formed respectively on the left end and the right end of the front-end wall. In addition, each of the cut-away portions may be a groove-shaped recess that is recessed forward from a rear-end surface of the front-end wall and that extends downward from a top surface of the front-end wall.

Also provided is yet another connector in which each of the cut-away portions may further have a bottom-end surface that is a slope slanted upwards toward a front side.

Also provided is still another connector in which each of the side walls may further include thin-wall portions. A first one of the thin-wall portions is formed between the locking protrusion and the front end of the side wall, and a second one of the thin-wall portions is formed between the locking protrusion and the rear end of the side wall portion.

Also provided is even still another connector, in which the locking protrusion may be located at a position in the front-to-rear direction between the bottom end of the auxiliary metal fixture and the bottom end of the connection part of the terminal.

Also provided is a connector assembly including: a connector of the present disclosure and a counterpart connector. The counterpart connector includes: a counterpart housing configured to be mated with the housing, and a counterpart terminal configured to be brought into contact with the terminal.

According to the present disclosure, a highly reliable connector and a highly reliable connector assembly can be provided that allow a flexible housing to be elastically deformed so that the locking protrusions do not wear away and that the lock holding power can be maintained.

BRIEF DESCRIPTION OF DRAWINGS

FIG. 6A is a perspective view seen from below, while FIG. 6B is a perspective view seen from above.

FIG. 7A is a plan view.

FIG. 7B is a sectional view taken along the line C-C in FIG. 7A and viewed as indicated by the arrows. FIG. 7C is a sectional view taken along the line D-D in FIG. 7A and viewed as indicated by the arrows.

DETAILED DESCRIPTION OF THE PREFERRED EMBODIMENTS

An embodiment will be described in detail below with reference to drawings.

Figure 1:
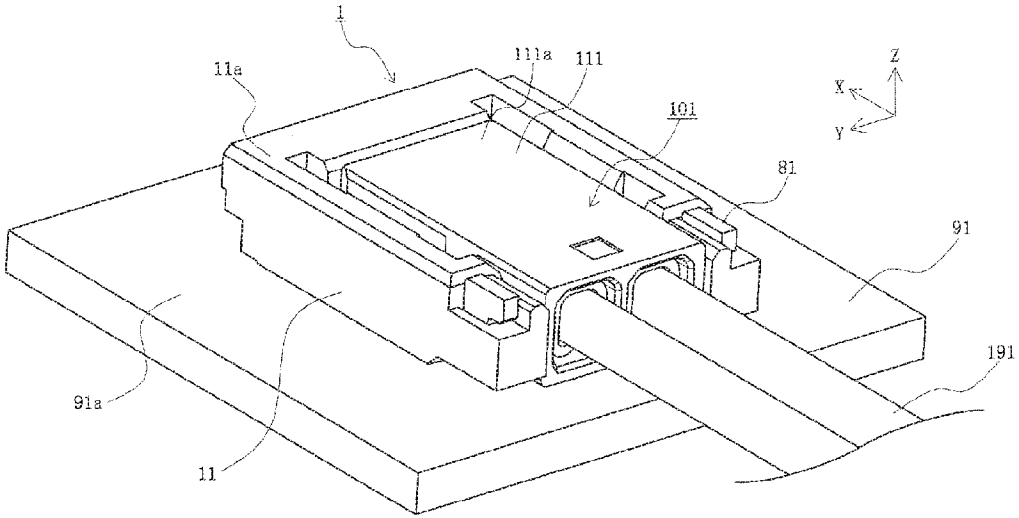
FIG. 1 is a perspective view illustrating a state where a wire connector and a board-side connector according to an embodiment are mated together.
Figure 2:
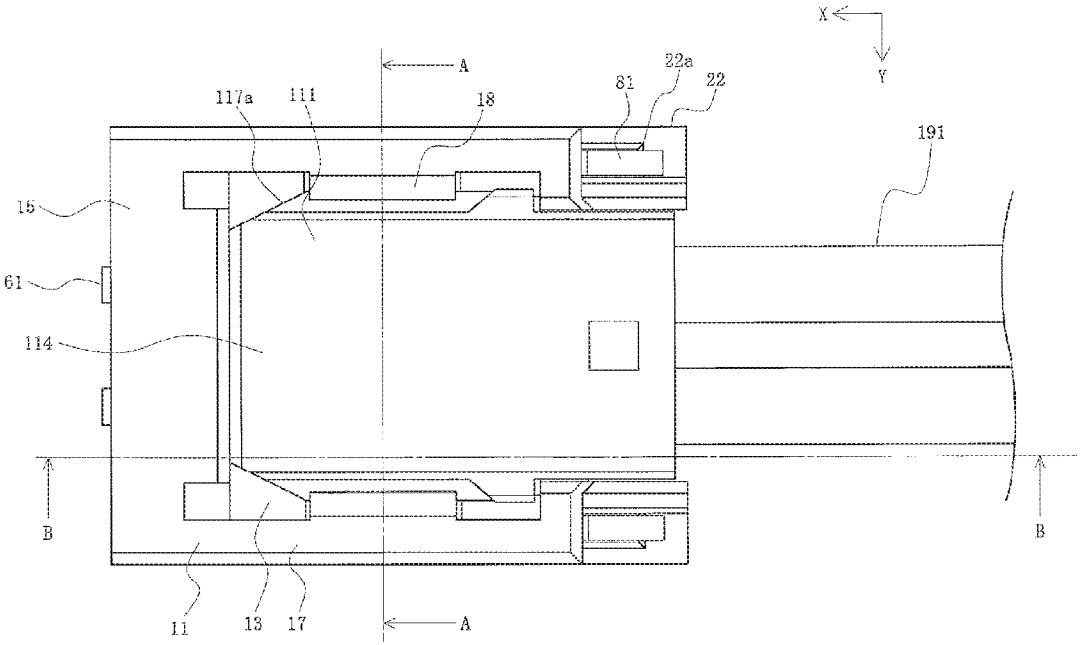
FIG. 2 is a plan view illustrating a state where the wire connector and the board-side connector according to the embodiment are mated together.
Figure 3:
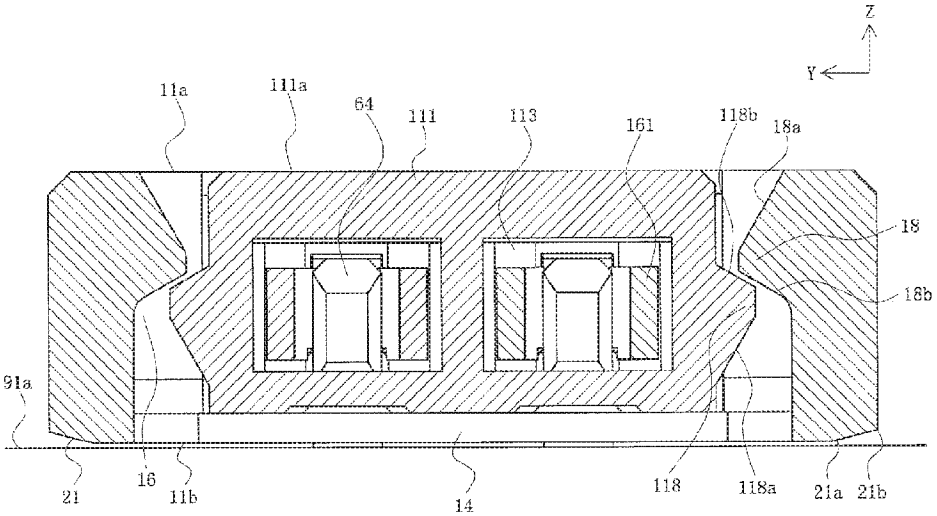
FIG. 3 is a cross sectional view illustrating the state where the wire connector and the board-side connector according to the embodiment are mated together, and is a sectional view taken along the line A-A in FIG. 2 and viewed as indicated by the arrows.
Figure 4:
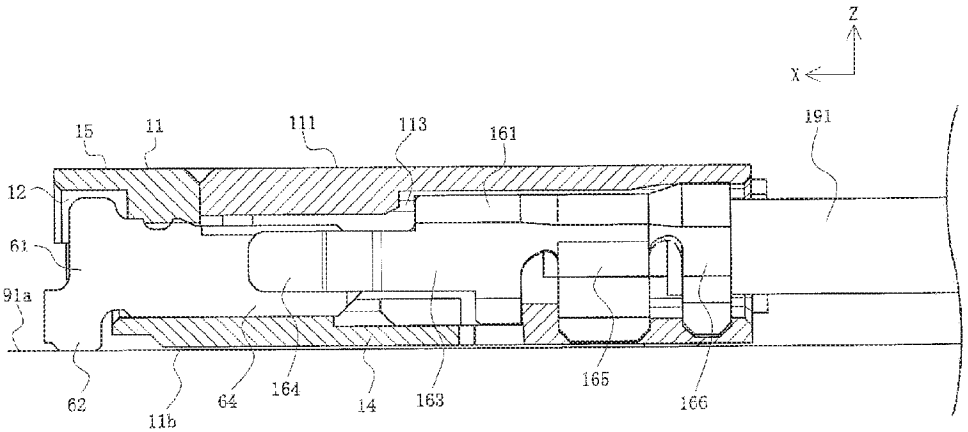
FIG. 4 is a longitudinal sectional view illustrating the state where the wire connector and the board-side connector according to the embodiment are mated together, and is a sectional view taken along the line B-B in FIG. 2 and viewed as indicated by the arrows.
Figure 5:
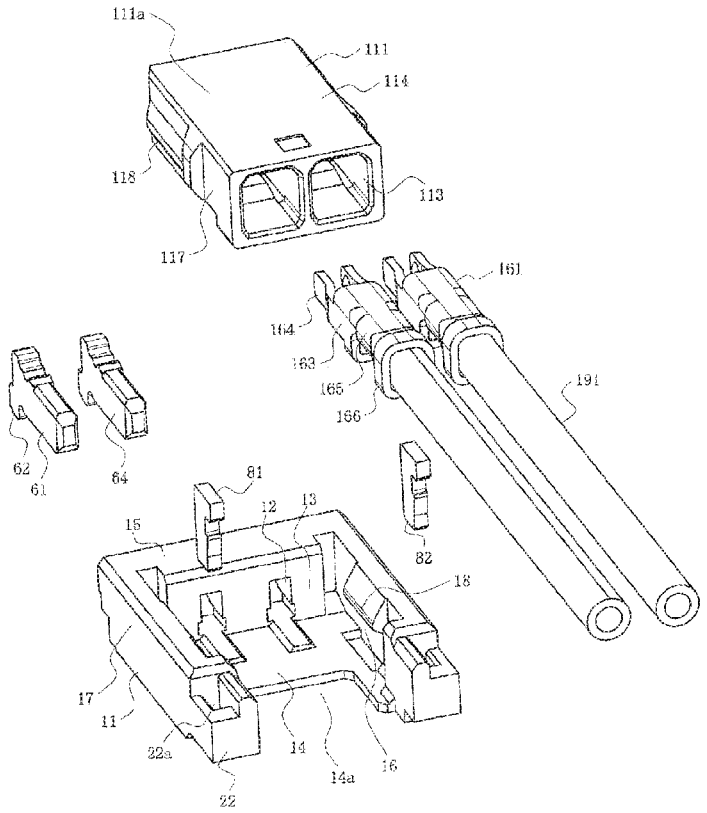
FIG. 5 is an exploded view of the wire connector and the board-side connector according to the embodiment.

FIG. 1 is a perspective view illustrating a state where a wire connector and a board-side connector according to the present embodiment are mated together. FIG. 2 is a plan view illustrating a state where the wire connector and the board-side connector according to the present embodiment are mated together. FIG. 3 is a cross sectional view illustrating the state where the wire connector and the board-side connector according to the present embodiment are mated together, and is a sectional view taken along the line A-A in FIG. 2 and viewed as indicated by the arrows. FIG. 4 is a longitudinal sectional view illustrating the state where the wire connector and the board-side connector according to the present embodiment are mated together, and is a sectional view taken along the line B-B in FIG. 2 and viewed as indicated by the arrows. FIG. 5 is an exploded view of the wire connector and the board-side connector according to the embodiment.

In the figure, a board-side connector 1 is a connector of the present embodiment, and is a first one of a pair of connectors that form a connector assembly. The board-side connector 1 is mounted on a surface 91*a* of a board 91, and is, for example, a low-profile compact connector having a height (Z-axis direction dimension) of approximately 1.0 to 2.0 mm, a width (Y-axis direction dimension) of approximately 3.0 to 5.0 mm, and a length (X-axis direction dimension) of approximately 3.0 to 5.0 mm. In addition, a wire connector 101 is a counterpart connector according to the present embodiment, and is a second one of the pair of connectors that form the connector assembly. The wire connector 101 is connected to terminations of a plurality of electrical wires 191, and is used for electrically connecting the electrical wires 191 to the board-side connector 1. The wire connector 101 is, for example, a low-profile compact connector having a height dimension of approximately 0.98 to 1.98 mm, a width of approximately 2.0 to 4.0 mm, and a length of approximately 2.0 to 4.0 mm. The wire connector 101 is vertically mated to the board-side connector 1. To put it differently, the board-side connector 1 and the wire connector 101 of the present embodiment are desirably low-profile compact vertically-mating connectors. These connectors 1 and 101 are horizontally-led-out cable type connectors, in which the electrical wires 191 are led out in parallel to the surface 91*a* of the board 91.

The board 91 is, for example, a printed circuit board, a flexible flat cable (FFC), a flexible printed circuit board (FPC), or the like used in electronic devices or the like. The board 91, however, may be any type of board. In the example illustrated in the drawings, there are only two electrical wires 191. The number of electrical wires 191, however, may be changed as desired, and thus there may be, for example, only one electrical wire, or there may be three or more electrical wires.

Note that expressions indicating directions, such as up, down, left, right, front, and back, used to describe the operations and configurations of the parts of the board-side connector 1 and the wire connector 101 in the present embodiment indicate no absolute directions but rather relative directions. The expressed directions are relevant when the board-side connector 1 and the wire connector 101 are in their respective orientations illustrated in the figures. In a case where these orientations change, these directions should be interpreted differently in accordance with the new orientations after the change.

The board-side connector 1 is a plug connector and is formed integrally from an insulating material such as a synthetic resin. The board-side connector 1 includes: a board-side housing 11 serving as a housing that is mated with a wire-side housing 111, i.e., a counterpart housing; a board-side terminal 61 i.e., a metal terminal loaded in the board-side housing 11; and nails 81 serving as auxiliary metal fixtures loaded in the board-side housing 11. The board-side connector 1 described above is referred to as a plug connector because the board-side terminal 61 includes a contact portion 64 in the form of a plug that protrudes rearwards (i.e., in the X-axis negative direction). The board-side connector 1 may also be referred to as a receptacle connector because the mating of the connectors 1 and 111 are accomplished by inserting the wire-side housing 111 into the mating space 13.

Note that in the example illustrated in the drawings, there are two board-side terminals 61, but the number of board-side terminals 61 can be changed as desired in accordance with the number of electrical wires 191. The board-side connector 1 has a generally rectangular parallelepiped shape. The board-side connector 1 is attached to the board 91 with the bottom surface 11*b* of the board-side connector 1 facing the surface 91*a* of the board 91. The board-side connector 1 and the wire connector 101 are mated together by inserting, from above, the wire connector 101 into the board-side connector 1.

As illustrated in the drawings, the board-side housing 11 includes: a substantially rectangular flat plate-shaped bottom wall 14 facing the surface 91*a* of the board 91; a front-end wall 15 extending along a front-end-side (i.e., the side located in the positive x-axis direction and corresponding to the front-end side of the counterpart wire connector wire connector 101) edge of the bottom wall 14 and standing from the bottom wall 14; a left-and-right pair of side walls 17 each of which extends along the corresponding one of the two side edges of the bottom wall 14 and each of which stands from the bottom wall 14. Note that in the example illustrated in the drawings, the top surface of the front-end wall 15 and the top surfaces of the side walls 17 are substantially flush with one another and together form a top surface 11*a* of the board-side housing 11. The mating space 13 is a space having at least some of its borders (e.g., four sides) defined by the bottom wall 14, the front-end wall 15, and the side walls 17. The mating space 13 is a space into which the wire-side housing 111 of the wire connector 101 is inserted so that the mating space 13 and the wire-side housing are mated together. Note that in the example illustrated in the drawings, a bottom-wall opening 14*a*, i.e., a portion where there is no bottom wall 14, is formed in a portion of the bottom wall 14 near the rear end (i.e., the end located on the negative x-axis side) of the bottom wall 14.

In addition, a plurality of board-side-terminal accommodating recesses 12 with slit-shaped openings are formed in the front-end wall 15 of the board-side housing 11. The board-side terminals 61 are inserted in and are loaded in their corresponding board-side-terminal accommodating recesses 12. Note that in the example illustrated in the drawings, there are two board-side-terminal accommodating recesses 12, but the number of the board-side-terminal accommodating recesses 12 can be changed as desired in accordance with the number of board-side terminals 61.

The contact portion 64 of each board-side terminal 61 extends from the front-end wall 15 rearwards (i.e., in the negative X-axis direction) and extends standing from the bottom wall 14. The contact portion 64 is exposed within the mating space 13. Note that each board-side terminal 61 includes a solder tail 62 serving as a connection part of the board-side terminal 61. The solder tail 62 has its bottom end extending forwards (i.e., in the positive x-axis direction) from the front-side end of the bottom wall 14 and electrically connected, by soldering or the like method, to a board-side terminal member, such as a signal line, a contact pad, and a terminal, exposed on the surface 91*a* of the board 91. Note that the board-side terminal 61 functions as a first metal fixture configured to secure the board-side connector 1 to the board 91, while the solder tail 62 functions as a first board fixture.

In addition, each side wall 17 includes an auxiliary-metal-fixture mounting portion 22, which is formed integrally with the rear end of the side wall 17. The auxiliary-metal-fixture mounting portion 22 has an auxiliary-metal-fixture accommodating recess 22*a* that penetrates the auxiliary-metal-fixture mounting portion 22 in the vertical direction. Each of the nail 81 is inserted into the corresponding auxiliary-metal-fixture accommodating recess 22*a* and is loaded therein. Each nail 81 includes a solder tail 82 extending downwards (i.e., in the negative Z-direction) from the bottom surface of the auxiliary-metal-fixture mounting portion 22 and serving as a connection portion, and is a substantially rectangular metal plate-like member that is integrally molded. In addition, the solder tail portion 82 has a bottom end that is connected and fixed, by soldering or the like method, to a connector fixing portion, such as a connection pad, formed on the surface 91*a* of the board 91. Consequently, the nail 81 functions as a second metal fixture configured to secure the board-side connector 1 to the board 91, while the solder tail 82 functions as a second board fixture.

An engaging protrusion 18 is formed on the inside surface of each side wall 17 (i.e., each side wall 17's surface located on the inner-side, in the width direction, of the board-side housing 11). The engaging protrusion 18 protrudes towards the center, in the width direction, of the board-side housing 11 and serves as a locking protrusion. In addition, an engaging recess 16 is formed under the engaging protrusion 18 and serves as a locking recess that is recessed, relative to the engaging protrusion 18, toward the outer side, in the width direction, of the board-side housing 11. The engaging protrusion 18 is a portion configured to engage with a wire-side engaging protrusion 118, which is formed as a part of the wire-side housing 111 and which serves as a counterpart locking protrusion. The engaging protrusion 18 is formed in a portion of the side wall 17 that is apart from the front end and the rear end of the side wall 17. In addition, as illustrated in FIG. 3, the engaging protrusion 18 has a generally triangular sectional shape. A first slope 18*a* is formed on the upper side of the engaging protrusion 18, and a second slope 18*b* is formed on the lower side of the engaging protrusion 18. The first slope 18*a* extends obliquely downwards toward the center, in the width direction, of the board-side housing 11. The second slope 18*b* extends obliquely downwards toward the outer side, in the width direction, of the board-side housing 11.

In addition, slanted surfaces 21 are formed as parts of the bottom surface 11*b* of the board-side housing 11. As illustrated in FIG. 3, the position at which each slanted surface is formed is located at an edge on the outer-side end, in the width direction, of the board-side housing 11. To put it differently, the position is where the each of the left and right side edges of the bottom wall 14 is connected to the bottom end of the corresponding one of the left and right side walls 17. Each slanted surface 21 is formed to extend upwards toward the outer side, in the width direction, of the board-side housing 11 while widening the gap from the surface 91*a* of the board 91. In the width direction of the board-side housing 11, the area where the slanted surface 21 is formed stretches from a starting point 21*a* to an end point 21*b*, which is the intersection of the slanted surface 21 with the outer surface of the corresponding side wall 17.

The wire connector 101 is a plug connector, and is formed integrally from an insulating material such as a synthetic resin. The wire connector 101 includes: the wire-side housing 111, serving as a counterpart housing configured to be mated with the board-side housing 11 of the board-side connector 1; and wire-side terminals 161 serving as the counterpart metal terminals loaded in the wire-side housing 111. Wire-side-terminal accommodating recesses 113 are formed in the wire-side housing 111. Each of the electrical wires 191 has its termination to which a wire-side terminal 161 is connected. Each electric wire 191 is inserted and held in the corresponding wire-side-terminal accommodating recess 113. Note that in the example illustrated in the drawings, there are two wire-side terminals 161 and two wire-side-terminal accommodating recesses 113. However, the number of the wire-side terminals 161 and the number of the wire-side-terminal accommodating recesses 113 can be changed as desired in accordance with the number of electrical wires 191.

Each wire-side terminal 161 includes a main body 163; a left-and-right pair of plate-shaped contact portions 164 each of which extends forward from the main body 163; a core-wire gripper 165 connected to the rear end of the main body 163; and a sheath gripper 166 connected to the rear end of the core-wire gripper 165. The contact portions 164 pinch the contact portion 64 of the corresponding board-side terminal 61 from the left and right sides, and come into contact with the contact portion 64. Furthermore, the core-wire gripper 165 clamps and grips the core wire serving as an exposed conductive wire formed by removing the insulating sheath at the termination of the electrical wire 191. Hence, the core-wire gripper 165 maintains electrical conduction with the core wire. In addition, the sheath gripper 166 clamps and grips the electrical wire 191 including the insulating sheath. Hence, the connection with the electrical wire 191 is maintained.

The wire connector 101 has a generally rectangular parallelepiped shape. The wire connector 1 is inserted into and is mated with the board-side connector 1 with the bottom surface of the wire connector 101 facing the top surface of the board-side connector 1. To put it differently, the wire connector 101 is vertically mated with the board-side connector 1.

As illustrated in the drawings, the wire-side housing 111 includes: a cuboid-shaped main body 114, a left-and-right pair of side walls 117 of the main body 114; and wire-side engaging protrusions 118 serving as counterpart locking protrusions. Each of the wire-side engaging protrusions 118 protrudes from the surface of the corresponding one of the side walls, the surface being located on the outer side, in the width direction of the wire-side housing 111. Each of the wire-side engaging protrusions 118 protrudes towards the outer side, in the width direction of the wire-side housing 111. As illustrated in FIG. 2, obliquely-formed, tapered surfaces 117*a* are formed on the connecting portions in each of which the corresponding one of the left and right ends of the front-end surface of the main body 114 is connected to the front end of the corresponding one of the side walls 117. In addition, the top surface of the main body 114 is a flat surface, and forms a part of a top surface 111*a* of the wire-side housing 111. In a state where the wire-side housing 111 is inserted into and is mated with the mating space 13 of the board-side housing 11, the top surface 111*a* of the wire-side housing 111 is substantially flush with the top surface 11*a* of the board-side housing 11.

In addition, slit-shaped openings (not illustrated) of the individual wire-side-terminal accommodating recesses 113 are formed from the front-end surface to the bottom surface of the main body 114. In addition, in a state where at least a part of the contact portion 164 of each wire-side terminal 161 is located in the opening of the corresponding one of the wire-side-terminal accommodating recesses 113 and where the wire connector 101 is mated with the board-side connector 1, that part of the contact portion 164 is in contact with the contact portion 64 of the board-side terminal 61 that has entered the opening.

The wire-side engaging protrusions 118 are some of the members that form a locking mechanism configured to lock the wire connector 101 and the board-side connector 1. Beside the wire-side engaging protrusions 118, the engaging protrusions 18 and the engaging recesses 16 of the board-side housing 11 are members of locking mechanism. In addition, in the outer surface of each side wall 117, the corresponding wire-side engaging protrusion 118 is formed at a position closest to the front end. In a state where the wire-side housing 111 is mated with the board-side housing 11, the wire-side engaging protrusions 118 are accommodated in the corresponding engaging recesses 16 of the board-side housing 11. In addition, as illustrated in FIG. 3, each of the wire-side engaging protrusions 118 has a generally triangular sectional shape. A second slope 118*b* is formed on the upper side of the wire-side engaging protrusion 118, and a first slope 118*a* is formed on the lower side of the wire-side engaging protrusion 118. The second slope 118*b* extends obliquely downwards toward the outer side, in the width direction, of the wire-side housing 111. The first slope 118*b* extends obliquely downwards toward the center, in the width direction, of the wire-side housing 111. Note that the left and right wire-side engaging protrusions 118 are formed so that the distance between the vertices of the left and right wire-side engaging protrusions 118 is greater than the distance between the vertices of the left and right engaging protrusions 18 of the board-side housing 11.

In order to mate the wire connector 101 with the board-side connector 1 mounted on the surface 91*a* of the board 91, the operator positions the wire-side connector 101 by operating the wire connector 101 with his/her fingers or the like so that the bottom surface of the main body 114 of the wire-side housing 111 faces the top surface of the bottom wall 14 of the board-side housing 11. In addition, the orientation of the wire connector 101 is adjusted so that the front end of the wire connector 101 is directed in the same direction as the front end of the board-side connector 1, where the front-end wall 15 is formed. Then, the wire connector 101 is moved, relative to the board 91, vertically from above the board 91 to insert, from above, the wire-side housing 111 of the wire connector 101 into the mating space 13 of the board-side housing 11 of the board-side connector 1. Thus, the wire connector 101 is mated with the board-side connector 1 as illustrated in FIG. 1.

At this time, each of the contact portions 64 of the board-side terminals 61 of the board-side connector 1 enters the corresponding one of the wire-side-terminal accommodating recesses 113 of the wire connector 101, and comes into contact with the contact portions 164 of the corresponding one of the wire-side terminals 161 located in the corresponding wire-side-terminal accommodating recesses 113. Consequently, via the wire-side terminal 161 and the board-side terminal 61, the core wire of the electric wire 191 is electrically connected to the board-side terminal member formed in the board 91.

When the wire-side housing 111 is inserted into the mating space 13 of the board-side housing 11, the first slopes 118*a* of the wire-side engaging protrusions 118 are firstly brought into contact with the corresponding first slopes 18*a* of the engaging protrusions 18. When the operator applies a downward force to the wire-side housing 111, the wire-side engaging protrusions 118 move relatively downward in relation to the corresponding engaging protrusions 118 while the first slopes 118*a* of the wire-side engaging protrusions 118 slide against the corresponding first slopes 18*a* of the engaging protrusions 18. Consequently, the board-side housing 11 is elastically deformed, each side wall 17 is directed obliquely outward, and the distance between the vertices of the opposing left and right engaging protrusions 18 is widened. Hence, each of the wire-side engaging protrusions 118 moves beyond the corresponding engaging protrusion 18 and down to a position below the engaging protrusion 18. Thus, the engaging protrusion 118 enters and engages with the corresponding engaging recess 16. Consequently, as illustrated in FIG. 3, the second slopes 118*b* of the wire-side engaging protrusions 118 are now facing the corresponding second slopes 18*b* of the engaging protrusions 18. Hence, the locking between the wire connector 101 and the board-side connector 1 is reinforced, and the disconnection of the wire connector 101 from the board-side connector 1 is more reliably prevented.

Next, the board-side housing 11 of the board-side connector 1 will be described below in detail.

Figure 6A:
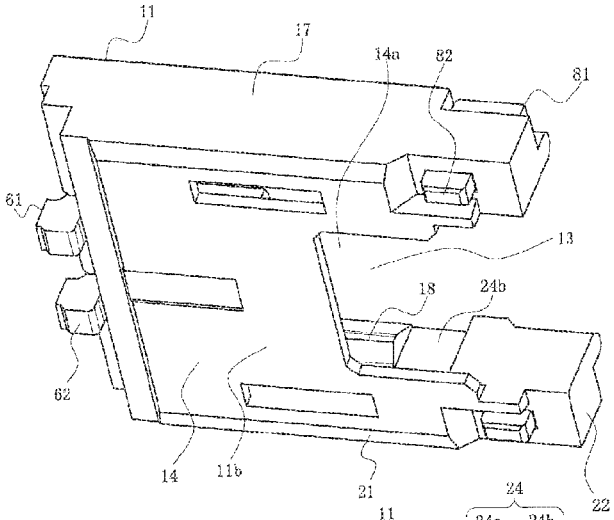
FIGS. 6A and 6B are perspective views each of which illustrates a board-side housing of the board-side connector according to the embodiment.
Figure 6B:
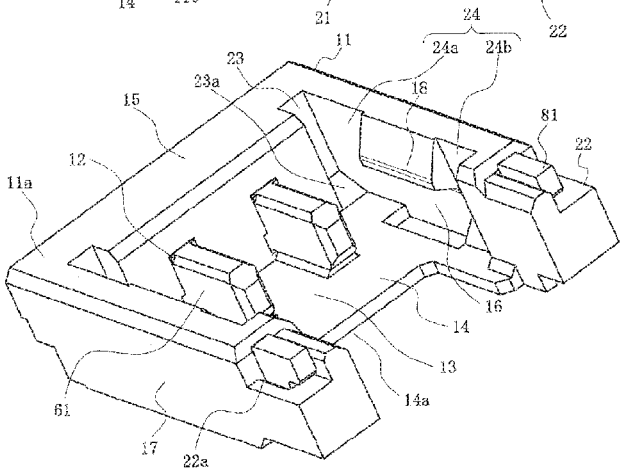
Figure 7A:
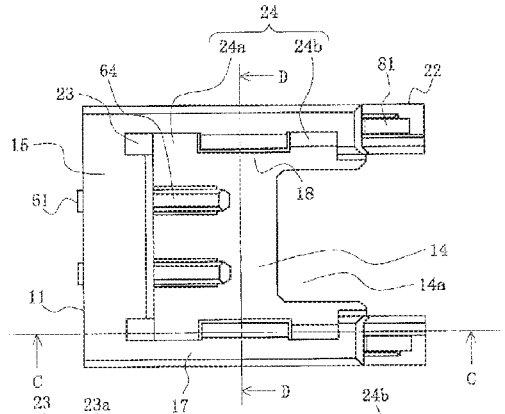
FIGS. 7A, 7B, and 7C are three orthographic views of the board-side housing of the board-side connector according to the embodiment.
Figure 7B:
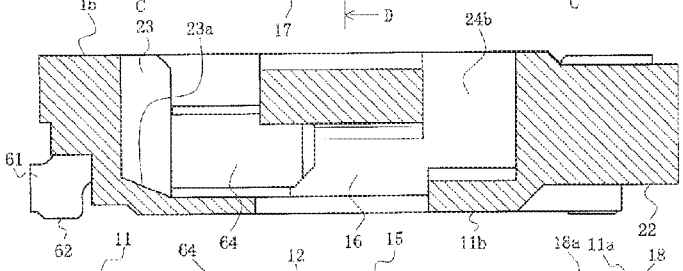
Figure 7C:
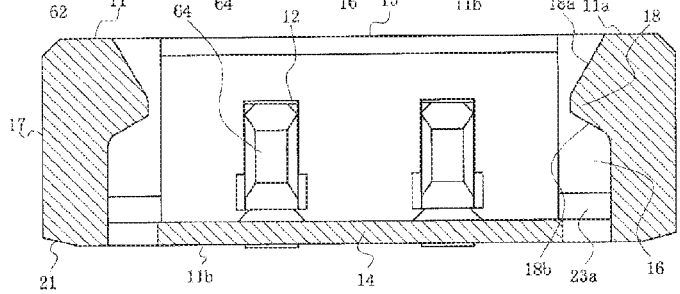
Figure 8:
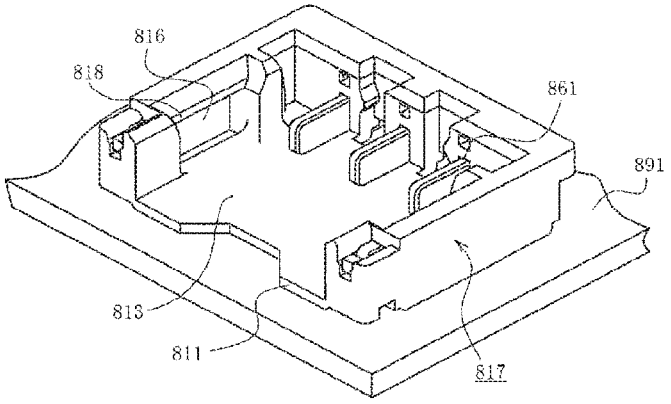
FIG. 8 is a perspective view illustrating a connector according to prior art.

FIGS. 6A and 6B are perspective views of the board-side housing of the board-side connector according to the present embodiment. FIGS. 7A, 7B and 7C are three surface views of the board-side housing of the board-side connector according to the present embodiment. Note that FIG. 6A is a perspective view seen from below, while FIG. 6B is a perspective view seen from above. FIG. 7A is a plan view. FIG. 7B is a sectional view taken along the line C-C in FIG. 7A and viewed as indicated by the arrows. FIG. 7C is a sectional view taken along the line D-D in FIG. 7A and viewed as indicated by the arrows.

As described earlier, when the wire connector 101 is mated with the board-side connector 1, each of the wire-side engaging protrusions 118 of the wire-side housing 111 and the corresponding one of the engaging protrusions 18 of the board-side housing 11 rub against each other. Hence, in a case where the board-side housing 11 is highly rigid and thus the engaging protrusions 18 are not displaced, the wearing of the wire-side engaging protrusions 118 and the engaging protrusions 18 progresses, to reduce the locking holding force. Hence, in the present embodiment, the rigidity of the board-side housing 11 is reduced to a certain degree, and the engaging protrusions 18 are allowed to be easily displaced elastically.

Specifically, the slanted surfaces 21 are formed in the left and right side edges of the surface of the bottom wall 14, the surface being the one facing the surface 91*a* of the board 91. The left and right side edges are the outer side, in the width direction, of the bottom surface 11*a* of the board-side housing 111 and are connected with the bottom ends of the left and right side walls 17. Each of the slanted surfaces 21 extends all along the corresponding side wall 17 in the front-to-rear direction (i.e., in the x-axis direction). Each slanted surface 21 is formed to extend upwards toward the outer side, in the width direction, of the board-side housing 11 while widening the gap from the surface 91*a* of the board 91.

As can be readily understood from FIG. 3, when the wire-side housing 111 is inserted into the mating space 13 of the board-side housing 11, through the pressing of the engaging protrusions 18 in the outward directions, in the width direction of the board-side housing 11, by the corresponding wire-side engaging protrusions 118, the left and right side walls 17 whose bottom ends are connected to each other by the bottom wall 14 are elastically deformed so that the top end of each side wall 17 collapses toward the outer side in the width direction of the board-side housing 11, that is, swings about its bottom end. Here, the slanted surfaces 21 are formed at locations corresponding to the bottom end of the bottom wall 14. In the width direction of the board-side housing 11, the area where each of the slanted surfaces 21 is formed stretches from the starting point 21*a* to an end point 21*b*. Each of the slanted surfaces 21 is formed so that the gap from the surface 91*a* of the board 91 is gradually widening. Hence, each side wall 17 rolls about a center located in its bottom end and corresponding to the starting point 21*a*, which is located more toward an inner position, in the width direction of the board-side housing 11, than the end point 21*b*. Hence, compared to a case where there are no slanted surfaces 21 formed, the top end of each of the left and right side walls 17 rolls easily towards the outer side in the width direction of the board-side housing 11. To put it differently, the left and right side wall portions 17 are elastically deformed easily, and the engaging protrusions 18 are elastically displaced easily toward the outer side in the width direction of the board-side housing 11.

In addition, each of the left and right side wall portions 17 has a front end that is connected to the corresponding one of the two ends of the front-end wall 15, which is fixed to the board 91 by means of the board-side terminals 61. In addition, each of the left and right side wall portions 17 includes, at its rear end, the auxiliary-metal-fixture mounting portion 22, which is fixed to the board 91 by means of the nail 81. Hence, in a case where each of the wire-side engaging protrusions 118 pushes the corresponding engaging protrusion 18 and thus the top end of the engaging protrusion 18 rolls towards the outer side in the width direction of the board-side housing 11, the entire side wall 71 is distortedly deformed. Accordingly, as illustrated in FIGS. 6A to 7C, a front-side thin-wall portion 24*a* and a rear-side thin-wall portion 24*b* are formed respectively on the front side and the rear side of the engaging protrusion 18 in each of the side walls 17. Note that, in a case where the front-side thin-wall portion 24*a* and the rear-side thin-wall portion 24*b* are described collectively, they are referred to simply as the "thin-wall portion(s) 24." In each side wall 17, the portion where the engaging protrusion 18 is integrally formed is thickly-walled due to the presence of the engaging protrusion 18, and is thus less likely to be distortedly deformed. However, the portion located on the front side of the above-mentioned portion and the portion located on the rear side back portion of the above-mentioned portion are thin-wall portions 24, and can thus be distortedly deformed easily. As described above, each side wall 17 is distortedly deformed easily at the thin-wall portions 24 located on the front side and on the rear side of the engaging protrusion 18. Hence, the engaging protrusion 18 is elastically displaced easily toward the outer side in the width direction of the board-side housing 11.

Note that the thickness (i.e., the dimension in the y-axis direction) of the side wall 17 of the thin-wall portion 24 is equal to the thickness of the side wall 17 in the engaging recess 16. In addition, the dimension, in the width direction (i.e., in the Y-axis direction) of the slanted surface 21, that is, the dimension measured from the starting point 21*a* to the end point 21*b*, is preferably set to be equal to or thicker than half the thickness of the side wall 17 in the thin-wall portion 24. In a case where the slanted surface 21 has a large dimension in the width direction as described above, the side wall 17 rolls easily so that the top end of the side wall 17 moves towards the outer side in the width direction of the board-side housing 11.

In addition, a bottom-wall opening 14*a* is formed at a position near the rear end of the bottom wall 14. Hence, the bottom wall 14 has a weaker power of restraining the movement of side walls 17 than in a case of having no such bottom-wall opening 14*a*, and thus the side walls can be distortedly deformed more easily. Accordingly, each of the engaging protrusions 18 is elastically displaced easily toward the outer side in the width direction of the board-side housing 11.

In addition, cut-away portions 23 are formed in the connecting portions where the front ends of the left and right side walls 17 are connected respectively to the left and right ends of the front-end wall 15. Each of the cut-away portions 23 is a groove-shaped recess that is recessed forward from a rear-end surface (i.e., the end surface located in the negative x-axis direction) of the front-end wall 15 and that extends downward from the top surface of the front-end wall 15. The bottom-end surface of the cutaway portion 23 is a slope 23*a*. Note that in each of the cut-away portions 23, the inner surface located on the outer side in the width direction of the board-side housing 11 is flush with the inner-side side surface of the front-side thin-wall portion 24*a* of the corresponding side wall 17. In addition, the slope 23*a* has a rear end that is at the same level as the top surface of the bottom wall 14. From the rear end, the slope 23*a* is slanted upwards toward the front side. The cut-away portions 23 result in a reduced thickness (i.e., the dimension in the x-axis direction) of the front-end wall 15 at the connection portions with the front ends of the left and right side walls 17. Hence, the front-end wall 15 has a reduced power of restraining the front ends of the side walls 17. Consequently, each of the side walls 17 can be distortedly deformed easily at the front-side thin-wall portion 24*a*. As described above, each side wall 17 is distortedly deformed easily at the front-side thin-wall portion 24 located on the front side of the corresponding engaging protrusion 18. Hence, the engaging protrusion 18 is elastically displaced more easily toward the outer side in the width direction of the board-side housing 11 than otherwise.

Note that the slopes 23*a* result in an increased thickness (i.e., the dimension in the z-axis direction) of the bottom wall 14 at the bottom ends of the connection portions of the front-end wall 15 with the front ends of the left and right side walls 17. Hence, the front-end wall 15 and the bottom wall 14 have an increased power of restraining the front ends of the side walls 17. Consequently, each of the side walls 17 can be distortedly deformed less easily at the front-side thin-wall portion 24*a* than otherwise. To put it differently, by forming the slopes 23*a*, the easiness of distortedly deforming the side walls 17 at the front-side thin-wall portions 24*a* is controlled. Accordingly, it is possible to appropriately control the easiness of elastically displacing the engaging protrusions 18 by adjusting the easiness of distortedly deforming the side walls 17. The easiness of distortedly deforming the side walls 17 can be adjusted by adjusting the thickness of the bottom wall 14 in the slopes 23*a* while the thickness of the bottom wall 14 in the slopes 23*a* can be adjusted by adjusting the slanting of the slopes 23*a*.

As has been described so far, in the present embodiment, the board-side connector 1 includes: the board-side housing 11 made from an insulating material; and the board-side terminal 61 loaded in the board-side housing 11. The board-side connector 1 mates with the wire connector 101 that includes: the wire-side housing 111; and the wire-side terminal 161 loaded in the wire-side housing 111. In addition, the board-side housing 11 includes: the bottom wall 14 facing the surface 91*a* of the board 91; the front-end wall 15 extending along the front-end edge of the bottom wall 14; the left-and-right pair of side walls 17 connected respectively to the left and right ends of the front-end wall 15 and extending respectively along the left and right side edges of the bottom wall 14; and the mating space 13, at least some of whose borders are defined by the bottom wall 14, the front-end wall 15, and the side walls 17. Each of the side walls 17 includes: the engaging protrusion 18, which engages the wire-side engaging protrusion 118 of the wire-side housing 111 when the wire-side housing 111 is inserted into the mating space 13, the engaging protrusion 18 being formed in a portion apart from both the front end and the rear end of the side wall 17; and the auxiliary-metal-fixture mounting portion 22 formed at the rear end of the side wall 17, the bottom end of the auxiliary-metal-fixture mounting portion 22 being loaded with the nail 81, which is to be fixed to the surface 91*a* of the board 91. The board-side terminal 61 includes the solder tail 62 whose bottom end is fixed to the surface 91*a* of the board 91. The board-side terminal 61 is loaded in the front-end wall 15. In each of the left and the right side edges of the surface of the bottom wall 14 facing the surface 91*a* of the board 91, the slanted surface 21 is formed extending all along the front-to-rear dimension of the side wall 17 so that the slanted surface 21 extends towards the outer side of the board-side housing 11 with a gradually widening gap with the surface 91*a* of the board 91.

Consequently, the left and the right side walls 17 are elastically deformed easily, and the engaging protrusions 18 are elastically displaced easily toward the outer side in the width direction of the board-side housing 11. Allowing the flexible board-side housing 11 to be elastically deformed enables the lock holding power to be maintained without causing the engaging protrusions 18 to wear away. Hence, the reliability of the board-side connector 1 can be enhanced.

In addition, the front-end wall 15 includes cut-away portions 23 formed on the left and the right ends of the front-end wall 15. Each of the cut-away portions 23 is a groove-shaped recess that is recessed forward from the rear-end surface of the front-end wall 15 and that extends downward from the top surface of the front-end wall 15. Hence, each of the side walls 17 can be distortedly deformed easily at the front side of the corresponding engaging protrusion 18. Accordingly, each of the engaging protrusions 18 can be elastically displaced easily toward the outer side in the width direction of the board-side housing 11.

In addition, the bottom-end surface of each of the cut-away portions 23 is the slope 23*a* that is slanted upwards toward the front side. Hence, by adjusting the easiness of distortedly deforming the side walls 17, the easiness of elastically displacing the engaging protrusions 18 can be controlled appropriately.

In addition, in each of the side walls 17, the thin-wall portions 24 are formed both between the engaging protrusion 18 and the front end of the side wall 17 and between the engaging protrusion 18 and the rear end. As described above, each side wall 17 is distortedly deformed easily at the thin-wall portions 24 located on the front side and on the rear side of the engaging protrusion 18. Hence, the engaging protrusion 18 is elastically displaced easily toward the outer side in the width direction of the board-side housing 11.

Furthermore, each of the engaging protrusions 18 is located at a position in the front-to-rear direction between the bottom end of the nail 81 and the bottom end of the solder tail 62 of the board-side terminal 61. Accordingly, each of the engaging protrusions 18 is elastically displaced easily toward the outer side in the width direction of the board-side housing 11.

Note that the disclosure of the present specification describes characteristics related to a preferred and exemplary embodiment. Various other embodiments, modifications and variations within the scope and spirit of the claims appended hereto could naturally be conceived by persons skilled in the art by summarizing the disclosures of the present specification.

The present disclosure is applicable to a connector and a connector assembly.

The invention claimed is:

1. A connector comprising:

a housing made from an insulating material; and a terminal loaded in the housing, the connector configured to be mated with a counterpart connector including a counterpart housing and a counterpart terminal loaded in the counterpart housing, wherein:

the housing includes: a bottom wall facing a surface of a board; a front-end wall extending along a front-end edge of the bottom wall; left and right side walls connected respectively to a left end and a right end of the front-end wall, and extending respectively along a left side edge and a right side edge of the bottom wall; and a mating space having borders which are at least partially defined by the bottom wall, the front-end wall, and the side walls, the front-end wall and the left and right side walls having top surfaces which are substantially flush with one another and together form a top surface of the housing, the front-end wall having a terminal accommodating recess formed therethrough which is provided below the top surface of the front-end wall, each of the side walls includes: a locking protrusion being formed in a portion of the side wall, the locking protrusion being apart from a front end of the side wall, apart from a rear end of the side wall, and apart from the bottom wall, the locking protrusion configured to engage with, and be positioned above, a counterpart locking protrusion of the counterpart housing inserted into the mating space; and an auxiliary-metal-fixture mounting portion formed integrally with the rear end of the side wall, the auxiliary-metal-fixture mounting portion extends rearwardly from the rear end of the side wall, the auxiliary-metal-fixture mounting portion defines an auxiliary-metal-fixture accommodating recess that is only open in a vertical direction, the auxiliary-metal-fixture accommodating recess configured to be loaded with an auxiliary metal fixture having a bottom end that is to be fixed to a surface of the board, the terminal is configured to be loaded in the terminal accommodating recess formed in the front-end wall, and includes a connection part having a bottom end that is to be fixed to the surface of the board, and the bottom wall has a surface facing the surface of the board, slanted surfaces are formed respectively on the left side edge and the right side edge of the surface of the bottom wall so that each of the slanted surfaces extend, in the front-to-rear direction, towards the outer side of the housing with a gradually widening gap with the surface of the board.

2. The connector according to claim 1, wherein:

the front-end wall includes cut-away portions formed respectively on the left end and the right end of the front-end wall, and each of the cut-away portions is a groove-shaped recess that is recessed forward from a rear-end surface of the front-end wall and that extends downward from a top surface of the front-end wall.

3. The connector according to claim 2, wherein each of the cut-away portions has a bottom-end surface that is a slope slanted upwards toward a front side.

4. The connector according to claim 1, wherein:

each of the side walls includes thin-wall portions, a first one of the thin-wall portions is formed between the locking protrusion and the front end of the side wall, and a second one of the thin-wall portions is formed between the locking protrusion and the rear end of the side wall portion.

5. The connector according to claim 1, wherein the locking protrusion is located at a position in the front-to-rear direction between the bottom end of the auxiliary metal fixture and the bottom end of the connection part of the terminal.

6. A connector assembly comprising:

the connector according to claim 1; and the counterpart connector including:

the counterpart housing configured to be mated with the housing, and the counterpart terminal configured to be brought into contact with the terminal.

7. The connector according to claim 1, wherein the bottom wall defines a bottom wall opening at or near a rear end of the bottom wall, the provision of the bottom wall opening causing the bottom wall to have a weaker power of restraining movement of the side walls, such that the side walls, and thus the locking protrusions, can be displaced outwardly.

* * * * *